United States Patent [19]

Hollaway

[11] 4,162,789

[45] Jul. 31, 1979

[54] BASEBALL BASE AND INSTALLATION APPARATUS

[76] Inventor: William D. Hollaway, 2000 - 34th St. NW., Canton, Ohio 44709

[21] Appl. No.: 852,090

[22] Filed: Nov. 16, 1977

[51] Int. Cl.[2] ..... A63B 71/00

[52] U.S. Cl. ..... 273/25; 33/137 R; 52/157

[58] Field of Search ..... 273/25, 1 C, 31; 272/3; 33/1 G, 137 R; 52/157, 127, 749, 158, 159; D10/71; 119/122; 173/18

[56] References Cited

U.S. PATENT DOCUMENTS

| | | | |
|---|---|---|---|
| 75,076 | 3/1868 | Taylor | 273/25 |
| 367,889 | 8/1887 | Brown | 273/25 |
| 464,205 | 12/1891 | Swope | 33/137 R |
| 501,811 | 7/1893 | Stombaugh | 52/157 |
| 2,046,126 | 6/1936 | Latina | 273/25 |
| 2,602,233 | 7/1952 | Irving | 33/137 K |
| 2,624,580 | 1/1953 | Corbett | 273/25 |
| 3,204,958 | 9/1965 | Velasquez | 273/25 |
| 3,466,039 | 9/1969 | Golomb | 273/25 |
| 3,572,705 | 3/1971 | Wybel | 273/25 |
| 3,698,144 | 10/1972 | Stratton | 52/157 |
| 3,836,146 | 9/1974 | Golomb | 273/25 |
| 3,952,523 | 4/1976 | Gale | 52/157 |
| 3,979,833 | 9/1976 | Grundman | 33/1 G |

FOREIGN PATENT DOCUMENTS

| | | | |
|---|---|---|---|
| 7373 | of 1905 | United Kingdom | 33/137 R |
| 699186 | 11/1953 | United Kingdom | 33/137 R |

*Primary Examiner*—Richard C. Pinkham
*Assistant Examiner*—T. Brown
*Attorney, Agent, or Firm*—Frease & Bishop

[57] ABSTRACT

A baseball base and installation apparatus whereby the base has attached to the bottom surface thereof a post having a non-circular cross-section. The installation apparatus includes a brace member, an anchor member having a top socket portion and a bottom screw auger portion, the top socket portion having a hollow interior complementary to the configuration of the non-circular post, and the screw auger portion being a flat strip of metal formed into a helical configuration. The brace member has a non-circular lug portion of a configuration complementary to the interior of the top socket portion and a handle portion for rotating the lug portion. The lug portion is telescopically inserted into the socket portion, the handle is rotated to install the anchor member into the ground. After the anchor member has been installed into the ground the brace member is removed and the post of the base is telescopically inserted into the socket portion.

4 Claims, 11 Drawing Figures

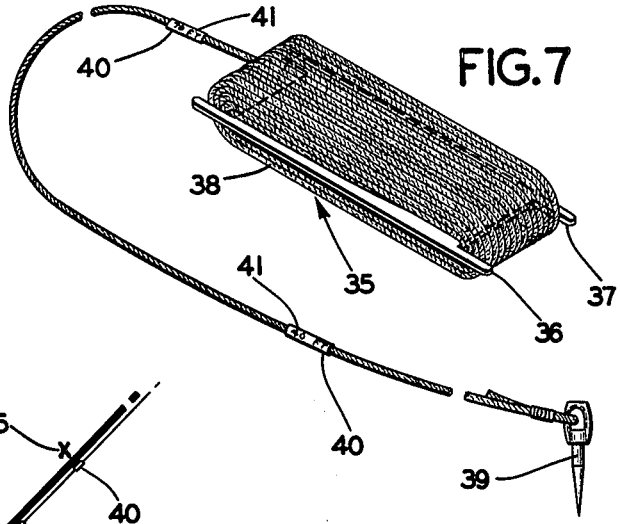
FIG.7
FIG.8
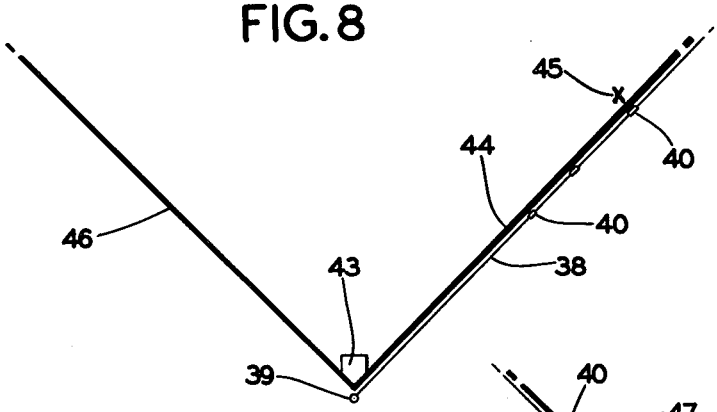
FIG.9
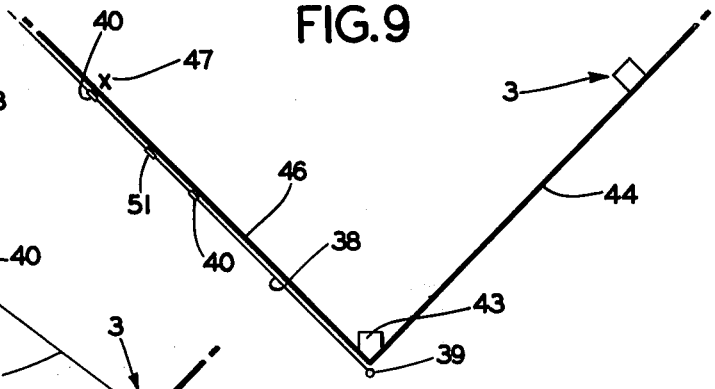
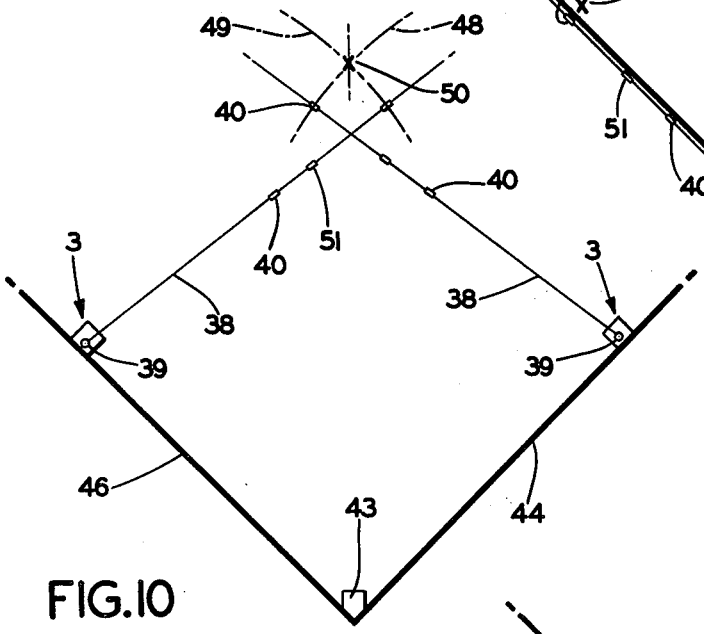
FIG.10
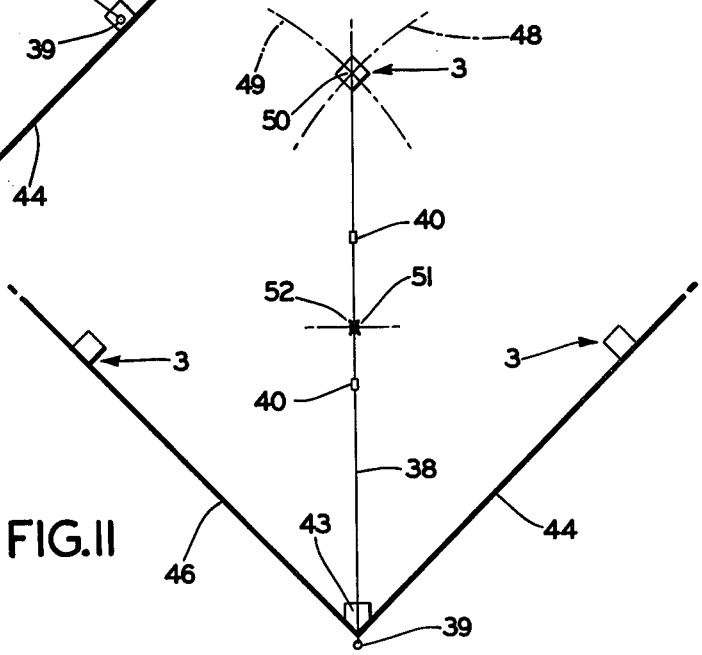
FIG.11

BASEBALL BASE AND INSTALLATION APPARATUS

BACKGROUND OF THE INVENTION

1. Field of the Invention

The invention relates to baseball fields, and in particular, to the bases therefor and their location. More particularly, the invention relates to a baseball base and apparatus for removably anchoring the bases in the determined positions for fields of various sizes.

2. Description of the Prior Art

The game of baseball and/or softball is played by people of all ages and by both sexes. The dimensions of the baseball diamond, that is, the distances between the bases, vary depending upon the particular age group playing the game. For example, the 9–10 year old age group will use a distance of 45 feet between the bases, the base distance for the 10–12 year old age group is 55 feet, the base distance for the 12–14 year old age group is 70 feet, and the base distance for groups over 15, up to and including major league baseball is 90 feet. Likewise, the various age groups and sexes may use other base distances for softball fields.

The various age groups and sexes in most areas will use the same ball field for playing their games due to the lack of playground space and facilities. This presents a problem in providing means for anchoring the bases at the required distances since the anchoring means cannot be installed permanently in the ground. Most types of permanent base anchors would be a hazard when another base distance is being used by the participants. Likewise, the playing fields in which such anchors would be used are in remote areas or playgrounds and would be subjected to constant vandalism and damage. Such problems are not encountered in professional ball parks, wherein the dimensions of the baseball diamond do not vary, and the playing area is in an enclosed secured area. The anchoring means for these bases are permanently installed in the ground and usually include a projecting or recessed post or socket for removably receiving a base thereon.

These wide ranges of base separations also require remeasuring the ball diamond area in order to determine the base locations before each game. This procedure is time consuming and can result in an improper layout if not done carefully and by someone experienced in this matter. Also, it usually will require two or more people to measure and layout the base positions.

Once the base positions are determined, it is desirable to provide anchor means for securing the bases to the ground to prevent the bases from rotating or moving. The anchoring means must be able to be installed and removed quickly and conveniently at the start and end of the game without appreciably marring the ground since this same area may be part of the playing field when different base distances are used. Most importantly, these base and anchor assemblies must not present a hazard to the participants, who at times slide into the bases with considerable force. Also, the bases must be able to maintain their anchored positions without movement when slid into by a runner to prevent arguments as to the status of the base runner.

Examples of various anchoring means for bases are shown in U.S. Pat. Nos. 75,076, 367,889, 2,046,126, 2,624,580, 3,204,958 and 3,572,705. The base and anchor assemblies shown in these patents use an anchor which is driven into the ground with a base being removably mounted thereon. Many of these assemblies are quite satisfactory if the driven anchor can remain in the ground with the bases being installed and removed at time of the game.

However, in sandlot and playground fields, these permanent anchors cannot be left in the ground, but must be removed after the game is completed and then reinstalled, as discussed above. Installation and removal of driven anchors is difficult in many locations due to the extreme hardness and condition of the ground which may be encountered, especially during dry periods of the summer. Also, a large mallet or sledge hammer must be transported and stored for satisfactorily installing these anchors. Removal of these driven anchors is difficult and may damage the field, especially when the anchor is of the proper size and is installed to a sufficient depth for securely holding the base.

Screw-type anchor and base assemblies, such as shown in U.S. Pat. Nos. 3,466,039 and 3,836,146 have been devised for anchoring a base in the proper position to eliminate a driven anchor. Helical screw-type anchors are difficult to install in hard ground and become bent after repeated use, making their subsequent installation extremely difficult and time consuming. Also, if the screw anchor is an integral part of the base, the entire assembly must be replaced if the anchor becomes bent and damaged.

Therefore, the need has existed for a removable anchor which can be installed and removed quickly and conveniently in and from the ground for securing a base thereon, and for a method enabling a single person to lay out the positions of the bases, even though the base separations may vary between games.

SUMMARY OF THE INVENTION

Objectives of the invention include providing apparatus for laying out a baseball diamond in which the distances between the bases may vary for each particular layout to accommodate the various age groups and sexes that may use the diamond layout; providing such apparatus which can be used by a single individual without any assistance, and which will provide an accurate positioning of the bases and also of the pitcher's mound or rubber in relation to the particular base dimensions being used; providing such apparatus which includes a relatively inexpensive measuring rope which has been premarked with dimensions of the usual base separations and distances between the home plate and pitcher's mound; providing apparatus for removably installing a base and anchor assembly at the determined location simply, conveniently and in a minimum amount of time and effort, and which installation can be carried out by a single individual and without the use of a mallet or hammer for driving an anchor stake into the ground; providing an anchor which is screwed into and out of the ground by a brace, which is relatively unaffected by the hardness of the ground, and which has a top socket member that is used both as the coupling connection for the brace and for securing a base mounted thereon; providing an anchor and base assembly in which the anchor and base are separate components, thereby enabling each to be replaced with a similar component should one of them become damaged, and in which the anchor and mounting components of the base are formed of rugged and durable metal which are able to withstand the shocks and forces exerted thereon during installation, removal and use in a game; and providing such an anchor and base assembly which can be assembled in kit form with the measuring rope for carrying out the steps of the invention, in which the various components are inexpensive to manufacture and assemble, are sturdy and durable in use, and which eliminate difficulties heretofore encountered, achieve the objectives indicated, and solve problems and satisfy needs existing in the art.

These objectives and advantages are obtained by the invention, the general nature of which may be stated as including means for removably anchoring one end of a flexible measuring rope at the home plate position; stringing the rope along a first base foul line; marking the position of first base adjacent the foul line at a predetermined distance from a distance indicator premarked on the rope; then stringing the rope along a third base foul line while the said one end of the rope remains anchored at home plate position; marking the position of third base adjacent the foul line at the same predetermined distance as first base from the premarked distance indicator; removably reanchoring the said one end of the rope at the first base location; inscribing an arc in the ground through the area of second base, with said arc having a radius equal to the predetermined distance of the first and third bases as indicated by the indicator on the rope; removably reanchoring the said one end of the rope at the third base location; and inscribing an arc equal in radius to the previously inscribed arc through the area of second base until intersecting said previous inscribed arc, with said intersection determining the location of second base.

These objectives and advantages are further obtained by the base and anchor assembly of the invention, the general nature of which may be stated as including a base having a bottom surface; noncircular post means mounted on the base and extending vertically downwardly from the bottom surface of the base; anchor means adapted to be removably installed in the ground, said anchor means including a top socket member having a noncircular hollow interior complementary to the configuration of the post means, and a screw auger firmly secured to the bottom of the socket member and extending vertically downwardly from said socket member; brace means including a noncircular lug having a configuration complementary to the interior of the socket member, and a handle for rotating the lug, said lug being adapted to be telescopically inserted into the interior of the socket member to removably install the anchor means in the ground by rotatably advancing the screw auger into the ground upon rotation of the brace means handle until the top of the socket member is flush with the top of the ground; and the post means being telescopically inserted into the socket member to secure the base in a fixed nonrotatable, predetermined position on a baseball field after removal of the brace means lug from within the socket member.

BRIEF DESCRIPTION OF THE DRAWINGS

A preferred embodiment of the invention—illustrative of the best mode in which applicant has contemplated applying the principles—is set forth in the following description and shown in the accompanying drawings, and is particularly and distinctly pointed out and set forth in the appended claims.

FIG. 7 is a fragmentary, diagrammatic perspective view of the premarked measuring rope and reel assembly used in carrying out the steps of the invention;

FIG. 8 is a diagrammatic view showing the method step of determining the first base position;

FIG. 9 is a diagrammatic view similar to FIG. 8 showing the step of determining the third base position;

FIG. 10 is a diagrammatic view similar to FIGS. 8 and 9 showing the step of determining the second base position; and FIG. 11 is a diagrammatic view showing the step of determining the location of the pitcher's mound.

Similar numerals refer to similar parts throughout the drawings.

DESCRIPTION OF THE PREFERRED EMBODIMENT

Figure 6:
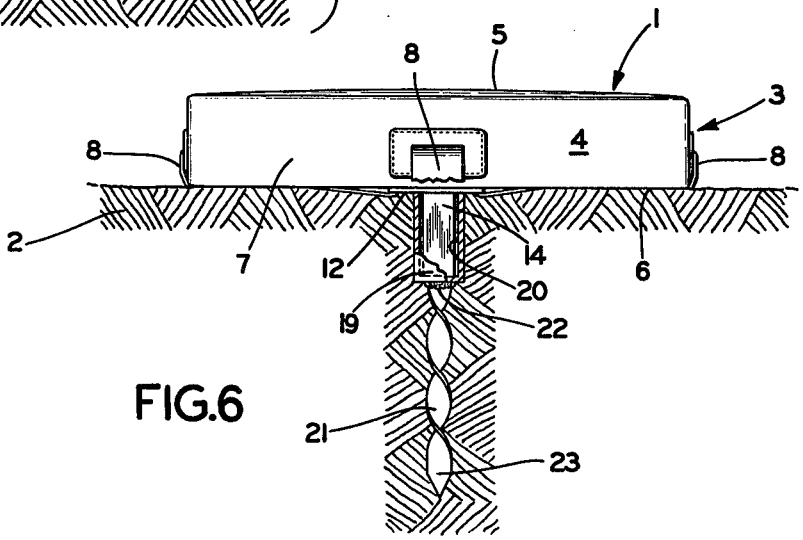
FIG. 6 is an elevational view, with portions broken away and in section, showing the base and post assembly of FIGS. 4 and 5 being telescopically engaged with the anchor of FIGS. 1 and 2 which is embedded in the ground.

The improved base and anchor assembly is indicated generally at 1, and is shown in FIG. 6 mounted in an anchored position on ground 2. The main step of the method of installing assembly 1 is shown in FIG. 1, with the steps of laying out a baseball diamond, that is, the positioning of first, second and third bases, being shown diagrammatically in FIGS. 8 through 11.

Base and anchor assembly 1 includes a usual rectangular base 3 (FIGS. 4 and 5) having a cover 4 generally formed of canvas or other synthetic materials which is filled with a slightly compressible, resilient material. Base 3 includes top and bottom surfaces 5 and 6 and four side surfaces 7. A pair of straps 8 extend from side surfaces 7 and overlap in a crossing configuration beneath base 3 adjacent bottom surface 6. Buckles 9 join the separated ends of straps 8. Base 3 and straps 8 are of a construction used for many types and styles of bases which are used with other types of anchoring means and form no novel part of the invention per se.

Figure 4:
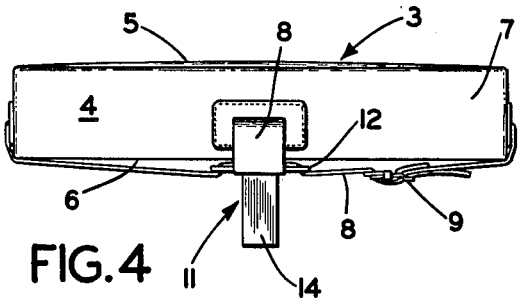
FIG. 4 is an elevational view of a base and mounting post assembly.
Figure 5:
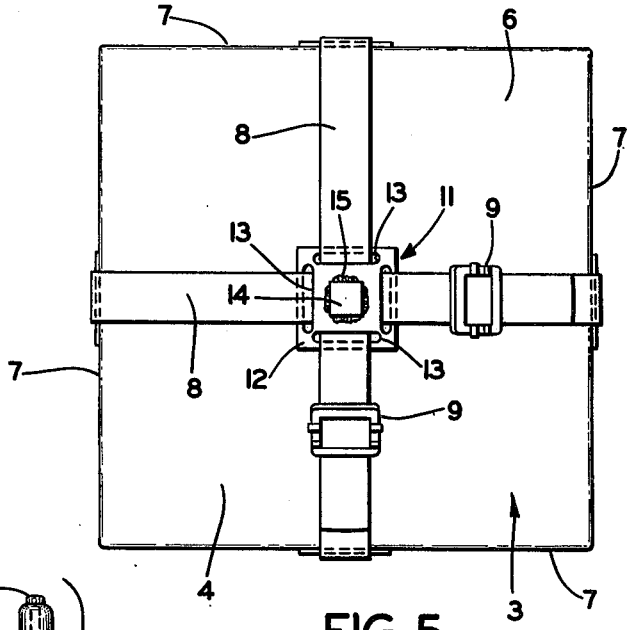
FIG. 5 is a bottom plan view of the base and post assembly shown in FIG. 4.

In accordance with one of the features of the invention, a post assembly, indicated generally at 11, is mounted on base 3 adjacent bottom surface 6. Post assembly 11 includes a flat, rectangular metal plate 12 formed with four elongated slots 13 adjacent the edges thereof (FIG. 5). Straps 8 extend through slots 13 in a crossing pattern for removably mounting post assembly 11 on base 3. A rectangular, solid metal post 14, preferably having a square cross-sectional configuration, is attached by a weld 15 to the center of plate 12 and extends vertically downwardly therefrom, as shown in FIGS. 4 and 6.

Figure 1:
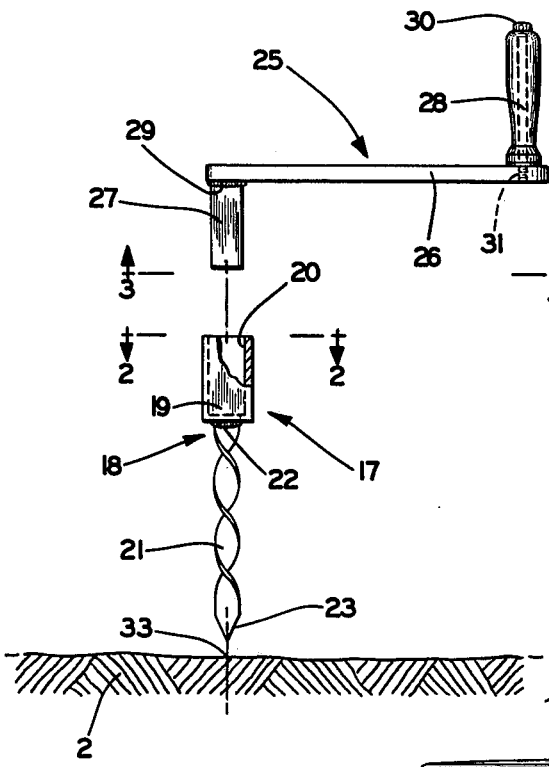
FIG. 1 is an exploded elevational view, with portions broken away and in section, of the base anchor and the brace for embedding and removing the same into and out of the ground.
Figure 2:
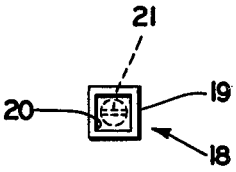
FIG. 2 is a top plan view of the anchor looking in the direction of arrows 2—2, FIG. 1.

The anchor assembly is indicated generally at 17 and is shown particularly in FIGS. 1 and 2. Assembly 17 includes a top socket member 18 having a housing 19 formed with a rectangular hollow interior 20. Interior 20 has a cross-sectional configuration complementary to that of post 14 so as to slidably receive post 14 therein in a slip-fit connection. A screw auger 21, consisting of a flat strip of metal formed into a helix, is secured to the bottom of the housing 19 by a weld 22. The extended end of auger 21 is formed into a point 23.

Figure 3:
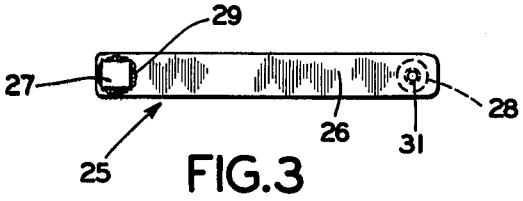
FIG. 3 is a bottom plan view of the brace looking in the direction of arrows 3—3, FIG. 1.

A brace indicated generally at 25 (FIGS. 1 and 3), is the only tool required for installing and removing base and anchor assembly 1. Brace 25 includes a flat lever bar 26 having a lug 27 and a handle 28 mounted on opposite ends of bar 26. Lug 27 is a solid metal member having a noncircular cross-sectional configuration equal in size and configuration to base post 14 and complementary to hollow interior 20 of socket member 18. Lug 27 is secured by a weld 29 to the bottom surface of lever bar 26 and extends vertically downwardly therefrom. Handle 28 is rotatably mounted on the other end of bar 26 by a shaft 30, the lower end of which is secured within a threaded opening 31 formed in lever bar 26.

Base and anchor assembly 1 is installed in a selected position easily and conveniently by the following procedure, shown particularly in FIGS. 1 and 6. Auger point 23 is placed in the ground at the point of attachment, indicated at 33, and brace lug 27 is telescopically inserted in hollow interior 20 of socket member 18. The length of lug 27 is generally equal to the depth of socket member 18 to provide a broad area of coupling engagement between ratchet 25 and anchor assembly 17.

Brace 25 and coupled anchor assembly 17 are rotated easily by rotation of handle 30 in a circular fashion about an imaginary center point formed by the axis of anchor assembly 17 and lug 27 while a small downward pressure is exerted on anchor 17. This rotation and pressure forcibly screws auger 21 downwardly into ground 2 until the top of socket member 18 is level or flush with the top of ground 2, as shown in FIG. 6. The mechanical advantage achieved by screw auger 21 and brace 25 enables anchor assembly 17 to be installed in the ground even if it is extremely hard or rocky, in contrast to a hand-turned screw anchor or driven stake, as in prior base anchoring means.

After anchor assembly 17 is installed to the proper depth, brace 25 is removed easily from its telescopic slip-fit engagement with socket member 18, and post 14 of post assembly 11 is telescopically inserted into socket interior 20 in a similar manner as is lug 27. This noncircular telescopical engagement of post 14 in socket interior 20 prevent any rotation of base 3 with respect to anchor assembly 17 or any lateral sliding movement of base 3 along the top of ground 2, even when slid forcibly into by a base runner. Sliding forces exerted on base 3 are absorbed by the connection between post 14 and socket housing 19 and is transferred to the surrounding ground and straps 8.

After a ball game is completed, base 3 is simply lifted vertically upwardly, slidably disengaging post 14 from within socket 18. Lug 27 then is reinserted into socket interior 20 and brace 25 is rotated in an opposite direction unscrewing anchor assembly 17 from its installed position in the ground. Again, only a minimum amount of force is required due to the mechanical advantage achieved by screw auger 21 and brace 25. Also, only a relatively small hole, generally equal to the outer diameter of socket housing 19, remains in the ground, which can be filled with surrounding dirt particles.

Base and anchor assembly 1 is intended for use with the measuring device indicated generally at 35 (FIG. 7), which is used in carrying out the steps of the method for laying out a baseball field, shown diagrammatically in FIGS. 8-11 and described below. Measuring device 35 includes a reel 36 consisting of a flat H-shaped piece of metal or rigid material having a rectangular-shaped notch 37 formed in each end thereof for storing and paying out a flexible measuring rope 38.

An anchor pin 39 is mounted on one end of rope 38 and has a plurality of distance or measurement indicating markers 40 attached to the rope and spaced throughout the length thereof. Markers 40 will be provided with distance indicating indicia 41 marked thereon, specifying the distance in feet from pin 39 to a particular marker 40. A plurality of these markers 40 will be attached to rope 38 and will have indicia corresponding to the usual base separations used for the various age groups and sexes, and also will include markers corresponding to the distances from home plate to the pitcher's rubber for these age groups. Rope 38 preferably is made of nylon or other synthetic material so as to be moisture resistant, light-weight and have sufficient strength for repeated use over a considerable number of years.

An individual, in carrying out the steps of the invention when laying out a baseball diamond, inserts pin 39 at the rear of home plate 43 (FIG. 8) and lays rope 38 along the first base foul line 44. The first base position then is marked, indicated at 45, adjacent an indicating marker 40 which corresponds to the particular base separation to be used for that game. The individual then repeats this procedure along the third base foul line 46 (FIG. 9), with the third base location being marked thereon, indicated at point 47, adjacent the same marker 40 on rope 38 used for determining the first base position.

Many playground and sandlot ball fields will have a home plate and foul lines established or marked in some manner, so that the steps of FIGS. 8 and 9 can be carried out without difficulty in locating the first and third base positions thereon. Pin 39 then is removably anchored in the ground alternately at the first and third base locations 45 and 47. Arcs 48 and 49 are inscribed in the ground adjacent the general area of second base (FIG. 10). The radius of arcs 48 and 49 is the selected distance between the bases, which is indicated by the selected indicating marker 40 used for first and third base. The intersection of arcs 48 and 49, indicated at 50, determines the second base position.

Pin 39 then is reanchored adjacent home plate 43 (FIG. 11) and rope 38 strung between pin 39 and the previously located second base position 50. Another distance indicating marker 51 on rope 38 locates the position of the pitcher's mound or rubber, indicated at 52. This pitching distance is known since it depends upon the particular distance between the bases and will vary with the age group of the players and whether baseball ot softball is to be played on the field.

A base 3 then is removably installed at positions 45, 47 and 50 in the manner described above and illustrated in FIGS. 1 and 6 of the drawings, to complete the baseball field layout and base installation procedure.

The assemblies and apparatus for carrying out the steps of the invention preferably will be sold in kit from. A kit will consist of three base and anchor assemblies 1, three anchors 17, a brace 25, and a measuring unit 35. These components can be stored and transported easily in a box or other container and enable a single person to completely lay out a baseball diamond and install the bases without assistance for various size fields.

The kit will be relatively light-weight since no heavy and bulky mallet or sledge hammer is required to install the base anchors. Brace 25 has a length of approximately one foot or less and weighs only approximately b 2–3 pounds even when made of a sufficient thickness metal to provide the desired strength and durability. Anchor assemblies 17, likewise, are approximately one foot in length or less and weigh approximately one pound each.

Accordingly, the improved method and apparatus of the invention enables an individual to quickly, conveniently and individually lay out a baseball field in which the base separations may vary for each layout, accurately and in a minimum of time. Likewise, the base anchors can be removably installed at the located positions securely and with a minimum of effort and apparatus, and removed easily and quickly upon conclusion of the game without appreciably marring the playing surface. The particular base and anchor assembly of the invention and the apparatus for removably installing the same are formed of a relatively few and inexpensive components which are sturdy and durable in use, which are able to withstand the shocks which they may encounter during play of the game, and which can be stored in a minimum amount of space and transported to and from the games easily and conveniently. Although the term "baseball" is used throughout the above description, the present method and apparatus of the invention is applicable to softball or to other games which may use bases.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the base locations are determined and installed, and the manner in which the base and anchor assembly is constructed and used, the characteristics of the construction, and the advantageous, new and useful results obtained; the new and useful structures, devices, elements, arrangements, parts, and combinations, are set forth in the appended claims.

I claim:

1. A kit for laying out a baseball field and for removably installing the bases therefor including:

(a) three bases, each of said bases having a bottom surface;

(b) post means adapted to be mounted on the base and extend vertically downwardly from the bottom surface;

(c) anchor means adapted to be removably installed in the ground, said anchor means including a top socket member having a hollow interior complementary to the configuration of the post means and a screw auger firmly secured to the bottom of the socket member and extending vertically downwardly from said socket member;

(d) brace means having a lug with a configuration complementary to the interior of the socket member and a handle for rotating the lug, said lug being adapted to be telescopically inserted into the interior of the socket member to removably install the anchor means in the ground by rotatably advancing the screw auger into the ground upon rotation of the brace means handle until the top of the socket member is flush with the top of the ground;

(e) the post means being adapted to be telescopically inserted into the socket member to secure the base in a fixed predetermined position on a baseball field after removal of the brace means lug; and (f) flexible measuring means for determining the position of the bases on a baseball field.

2. Apparatus for removably installing and securing a base on the ground for a ball field, including:

(a) a base having a bottom surface;

(b) strap means mounted on the base and extending beneath the base adjacent the bottom surface;

(c) post means including a flat metal plate formed with slots and a noncircular post fixed on the plate and extending vertically downwardly therefrom, the strap means extending through the plate slots to removably mount the post means on the base adjacent the bottom surface thereof;

(d) anchor means adapted to be removably installed in the ground, said anchor means including a top socket member having a noncircular hollow interior complementary to the configuration of the noncircular post, and a screw auger firmly secured to the bottom of the socket member and extending vertically downwardly therefrom, said screw auger being a flat strip of metal formed into a helical configuration;

(e) brace means including a vertical noncircular lug having a configuration complementary to the interior of the socket member and a handle for rotating the lug, said lug being adapted to be telescopically inserted into the interior of the socket member to install and remove the anchor means into and from the ground by rotating the screw auger upon rotation of the brace means handle with the top of the socket member being flush with the top of the ground when in the installed position; and (f) the post being telescopically inserted into the socket member to removably secure the base in a fixed nonrotatable position on the anchor means after removal of the brace means lug from within the socket member after installing the anchor means in the ground.

3. The apparatus defined in claim 2 in which the interior of the socket member, the brace means lug and the post means all have a rectangular cross-sectional configuration.

4. The apparatus defined in claim 2 in which the brace means includes a generally flat lever bar with the lug being fixed to one end thereof and extending downwardly from the bar, and with the handle being rotatably mounted on the other end of the bar and extending upwardly therefrom.

* * * * *